US005235833A

United States Patent [19]

Pinto

[11] Patent Number: 5,235,833

[45] Date of Patent: Aug. 17, 1993

[54] LOCKABLE LOCK FOR DRINK DISTRIBUTING TROLLEYS IN AIRCRAFT

[75] Inventor: Georges Pinto, Paray-Vieille-Poste, France

[73] Assignee: Air Inter Lignes Aeriennes Interieures, Paray-Vielle, France

[21] Appl. No.: 664,725

[22] Filed: Mar. 5, 1991

[30] Foreign Application Priority Data

Mar. 8, 1990 [FR] France ..... 90 02931

[51] Int. Cl.[5] ..... E05B 13/10; E05B 35/08

[52] U.S. Cl. ..... 70/471; 70/210; 70/337; 70/404; 70/432; 70/489

[58] Field of Search ..... 70/432, 403, 404, 150, 70/210, 337, 441, 467, 471, 484, 485, 489, DIG. 59; 280/47.35, 79.3

[56] References Cited

U.S. PATENT DOCUMENTS

| | | | |
|---|---|---|---|
| 817,551 | 4/1906 | Eller | 70/404 |
| 1,022,221 | 4/1912 | Augenbraun | 70/432 |
| 1,358,681 | 11/1920 | Parker | 70/218 |
| 1,585,105 | 5/1926 | Overdick | 70/432 |
| 2,784,993 | 3/1957 | Collar | 70/432 |
| 3,427,835 | 2/1969 | Jeffee | 70/432 |
| 4,275,577 | 6/1981 | Castaldo | 70/337 |
| 4,596,203 | 6/1986 | Lorek | 116/294 X |

FOREIGN PATENT DOCUMENTS

| | | | |
|---|---|---|---|
| 562983 | 12/1957 | Belgium | 70/432 |
| 10727 | 9/1880 | Fed. Rep. of Germany . | |
| 1923171 | 11/1970 | Fed. Rep. of Germany | 70/432 |
| 1119407 | 7/1968 | United Kingdom | 70/432 |

*Primary Examiner*—Lloyd A. Gall

*Attorney, Agent, or Firm*—Armstrong, Westerman, Hattori, McLeland & Naughton

[57] ABSTRACT

A lockable lock is disclosed, particularly for drink distribution trolleys in aircraft, comprising an additional latch (20) for locking the sliding bolt (7) whose movement is dependent on the pivoting movement of an operating and unlocking lever (8) which also displays, through the aperture (13), the provisioned state of the trolley, the lever (8) being actuated by a key fitted on its shaft (9).

6 Claims, 5 Drawing Sheets

LOCKABLE LOCK FOR DRINK DISTRIBUTING TROLLEYS IN AIRCRAFT

BACKGROUND OF THE INVENTION

1. Field of the Invention

The invention, which relates more particularly to trolleys for distributing drinks in aircraft, concerns a lock which can be locked automatically.

2. Description of the Prior Art

Drinks, and particularly fresh drinks, are distributed in aircraft by means of small trolleys which are heat insulated and have a plurality of shelves or compartments for storing these drinks. These trolleys are pre-stocked on the ground before being brought to the aircraft. It is the commercial navigating staff who distribute drinks to passengers before storing the trolley or trolleys, at least partially emptied, in a particular zone of the aircraft, where they will then be recovered during a replenishing stop. They thus effect a distribution circuit before returning to the preparation center.

During these multiple movements or handling by the navigating or non navigating staff, it is obviously necessary for these trolleys to be locked so as to avoid the theft of their contents. This is why, up to now these trolleys, whose inventory is made before each departure, are sealed with a certain color by the preparation center so as to show that they are fully provisioned. On board, the navigating staff, who have an appropriate tool, may unseal the trolley and distribute its contents. At the end of the service, the trolley must be re-sealed with another appropriate tool and marked to show that its contents have been depleted. That takes place, for example, by re-sealing with another color to thus show that it is incompletely provisioned. These operations occur on each flight until the end of the cycle when the trolleys are returned to the preparation center to be re-stocked.

This procedure involves the purchase of a large number of seals and the provision of sealing and unsealing tools for the apparatus or the navigating staff. Furthermore, the particular marking of the provisioned state of each trolley involves painting the seals in question with different colors.

It will be readily understood that such materials are expensive, but apart from this drawback, the sealing and unsealing operations are time-wasting and fastidious, whether at the preparation center or in flight for the navigating staff, without speaking of the risks of slight injuries (broken nails, injured fingers . . . ) caused by handling such tools.

These drawbacks have led the Applicant to perfect an automatically lockable lock, which can be unlocked by means of a key, which also displays the provisioned state of the trolley and which can be readily fitted on the normal doors of said trolleys.

SUMMARY OF THE INVENTION

Therefore, an object of the present invention consists of a lockable lock, particularly for drink distributing trolleys in aircraft, comprising a control handle operating a sliding bolt by means of a crank link, which lock is equipped with a supplementary latch for locking the sliding bolt whose movement is dependent on the pivoting movement of an operating and unlocking lever, which also plays the role of device displaying the provisioned state of the trolley, said lever being movable by means of a key allowing it to be rotated in two directions, and/or a key allowing the pivoting operation only in one direction of rotation.

The operating lever is attached to a pivoting shaft passing through an orifice of the door situated above the rotational shaft of the control handle of the sliding bolt, which pivoting shaft, through which a transverse pin passes, permits its rotation by means of keys.

In addition, the operating lever is in the form of a right-angled bracket with two legs, one leg of which has at its end a colored disc on its face oriented towards the door, which may appear through a display aperture provided in the door above the shaft and another leg of which has at its end a profiled opening through which passes a small shaft which is movable in said opening.

According to a particular characteristic of the invention, the latch extends vertically along the rear face of the door, between the operating lever with which it cooperates via the shaft passing through an aperture of said latch, and the sliding bolt. It is returned by a spring hooked on to a lug of the latch and a support plate of said latch. The lower part of the latch is in the form of an L whose flat end, as well as an adjacent rounded portion, are applied against the lower part of the cranked link of the sliding bolt.

According to another characteristic of the invention, the barrel of a key ends in a double diametrical notch able to be engaged on the pin, on each side of the shaft. Furthermore, the barrel of another key ends in notches bordered on one side by inclined surfaces and on the other by straight portions parallel to the longitudinal axis of the key which act in a single direction on the pin.

Other particular features, as well as the advantages of construction and operation of the lock according to the invention will be clear from the following description of one embodiment, with reference to the accompanying drawings.

DESCRIPTION OF THE PREFERRED EMBODIMENTS

Figure 1:
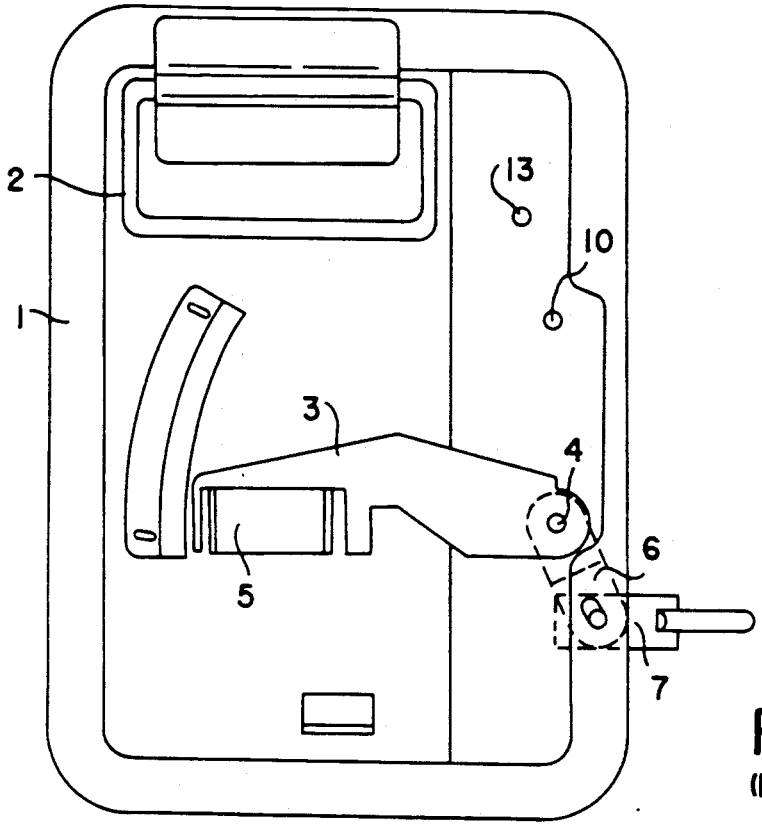
FIG.1 (PRIOR ART)
FIG. 1, a front view of a drink distributing trolley lock of the prior art.
Figure 2:
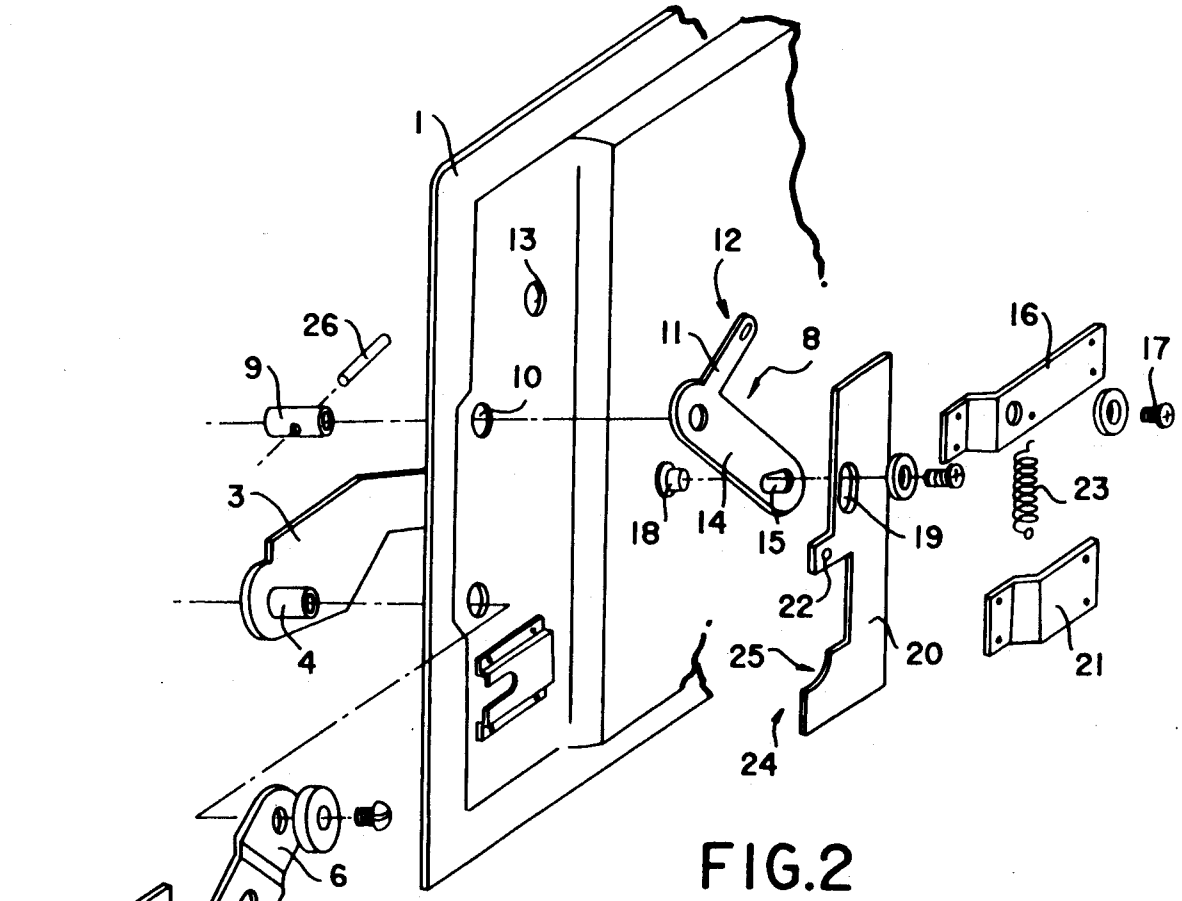
FIG. 2, an exploded perspective view of the lockable lock.

FIG. 1 shows a door lock of the prior art, showing the front visible and a plate of a door lock 1 of a trolley equipped with a folding handle 2 and a control handle 3 pivoting about a shaft 4 and able to occupy two positions C (closed) or O (open) marked on the front face of the door. In the closed position shown, handle 3 bears against a U shaped stop 5 able to serve for locking the handle in this position. At the level of its shaft 4, the handle is attached to a crank lever 6 for operating a sliding bolt 7 which, according to its position, projects or not into a fixed keeper not shown of the trolley 101. It will be noted that link 6 and the sliding bolt 7 are located behind the front plate of lock 1, as can be seen in FIG. 2. In FIG. 2, the complementary and component parts of the lockable lock are shown, which are mounted on the rear face of lock 1, which cannot be seen. Primarily, an operating and unlocked lever 8 is attached to a pivoting shaft 9 passing through an orifice 10 of the door located in line with and at some distance above the shaft 4 of handle 3. At the level of this lever 8, a support plate 16, fixed on the rear face of the door, has passing therethrough a screw 17 for fixing the pivoting shaft 9, which holds lever 8 in position and allows it to rotate. Lever 8 is in the form of a right-angled bracket with two legs, an upper leg 11 of which has at its end a colored disc 12 on its face oriented towards the door plate, which disc may appear through a display aperture 13 itself located above shaft 9. The lower leg 14 of lever 8 has at its end a profiled opening 15 in the form of an egg, through which a small shaft 18 passes, which is movable in opening 15 which itself passes through an elongate aperture 19 provided in latch 20. This latch 20 extends vertically and may slide along the rear face of door 1 between the support plate 16 and a complementary guide blade 21, also fixed to the door, or between the operating lever 8 and the sliding bolt 7. The latch has a particular shape with notably a lug 22 for hooking thereon a small return spring 23 fixed to the support plate 16.

The lower part of latch 20 is in the form of an L whose flat end 24, as well as an adjacent rounded portion 25, are intended to be applied against the lower part of link 6, under conditions which will be explained further on.

Figure 3:
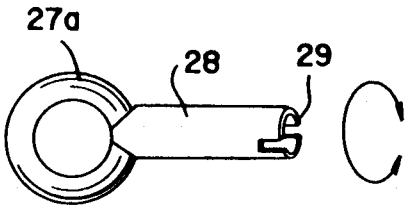
FIGS. 3 and 4, views of two types of operating keys.
Figure 4:
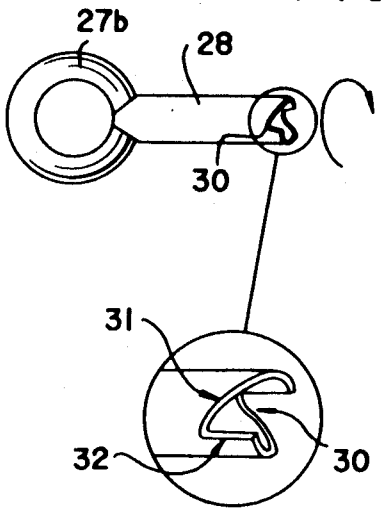

It will be understood that the assembly of these parts housed behind plate 1, namely essentially the operating lever 3 and latch 20, are attached to each other in a particular way. Only a front portion of the pivoting shaft 9 is apparent on the front of the door since it projects from orifice 10. It is this front portion of shaft 9 through which a transverse pin 26 passes which may be rotated by means of two types of key. On the one hand, a key 27*a*, shown in FIG. 3, is used solely by the preparation center, whose hollow cylindrical barrel 28 ends in a double diametrical notch 29 which may engage pin 26 on each side of shaft 9. This key 27*a* allows the user to operate it in both directions as shown by the arrow. On the other hand, a key 27*b*, shown in FIG. 4, is intended for the navigating staff, whose barrel 28 ends in notches 30 bordered on one side by inclined surfaces 31 and on the other by straight portions 32 parallel to the longitudinal axis of the key. The user can therefore rotate this key 27*b* only in one direction in which it is the straight portion 32 which bears against pin 26.

Figure 5:
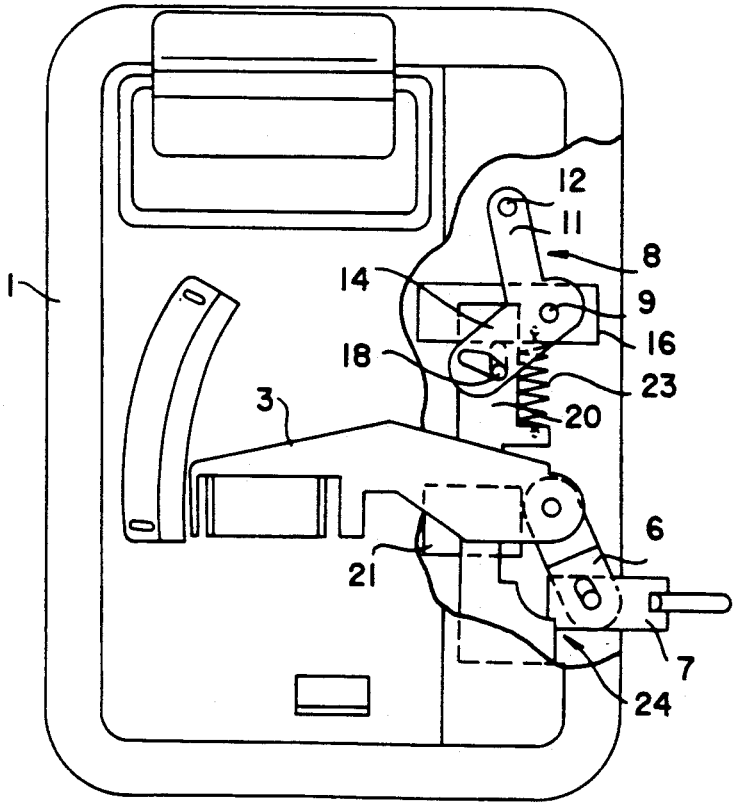
FIG. 5, a front view of a lock, with parts cut away, in the locked position.

The lock thus described operates in the following way. FIG. 5 illustrates the position of the different parts when door 1 is closed and the lock is locked.

This represents the situation of the lock of a provisioned trolley leaving the preparation center. To place the parts in this position, shaft 9 has had to be rotated with key 27*a* to bring disc 12 in line with the display aperture 13.

The control handle is then in a closed low position and thus, as usual, holds the sliding bolt 7 engaged in the fixed keeper via link 6. In this first situation, it can be seen that latch 20 is in a top position in which its lower flat end 24 is at the level of link 6 and consequently prevents sliding bolt 7 from returning inside door 1. There is thus locking of the sliding bolt and of the control handle. To this top position of latch 20 there corresponds—via shaft 18—a top position of leg 14 of the operating lever 8. Thus, the other leg 11 is substantially vertical and the colored disc 12 is in line with the display aperture 13. Thus, this color seen through said aperture indicates that the door is locked and that the provision of the trolley is complete.

If the preparation center for any reason whatsoever desires to open the door of a trolley 101 thus locked, the key 27*a* is available.

Figure 6:
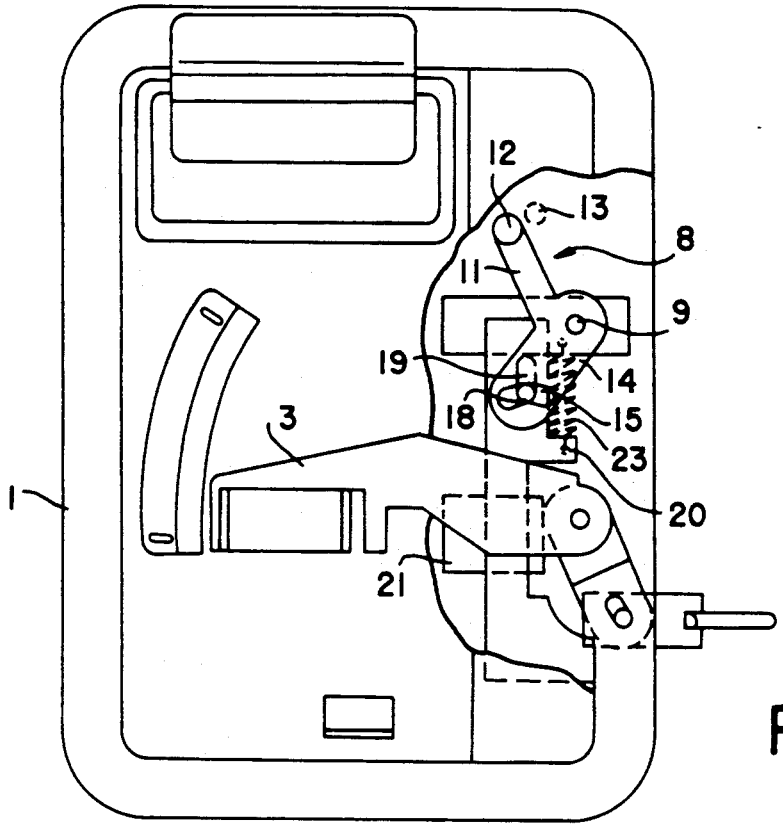
FIG. 6, the same view showing the first unlocking phase and FIG. 7 the second unlocking phase.

The trolley 101 thus locked which has been transferred to an aircraft, must be unlocked by the navigating staff by means of key 27*b* which they have available. They fit then the key on the pivoting shaft 9 and rotate it in the only direction possible in which the straight portions 32 may act on pin 26. In a first phase, lever 8 will turn, which firstly results in freeing laterally leg 11 of the lever and retracting the colored disc 12 outside the display aperture 13, as can be seen in FIG. 6. Through this aperture a background on the back part of the door lock having a color other than the disc 12 can then be seen indicating unlocking. During this first phase of the rotational movement, the small shaft 18 has a relative bottom to top movement inside the profiled opening 15 during the downward movement of leg 14 of lever 8. During the second phase of the rotational movement, lowering of the lower leg 14 of lever 8 will act on latch 20, by the action of shaft 18 on the base of its aperture 19, and will then cause it to slide downwards in the guide blade 21, against the return force of spring 23.

Figure 7:
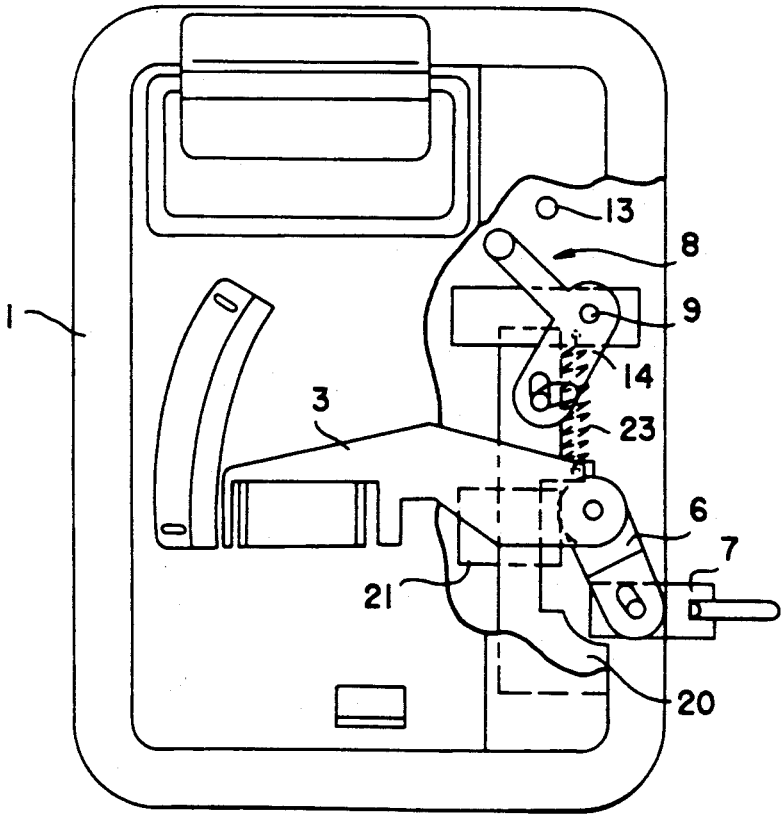
Figure 8:
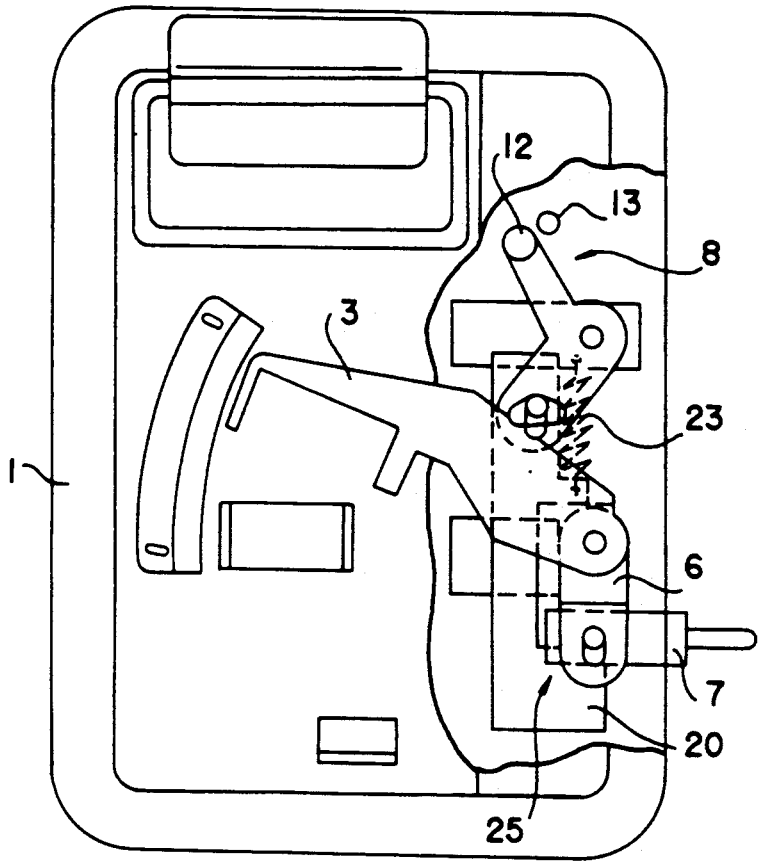
FIG. 8, the same view showing the lock in the open position.
Figure 9:
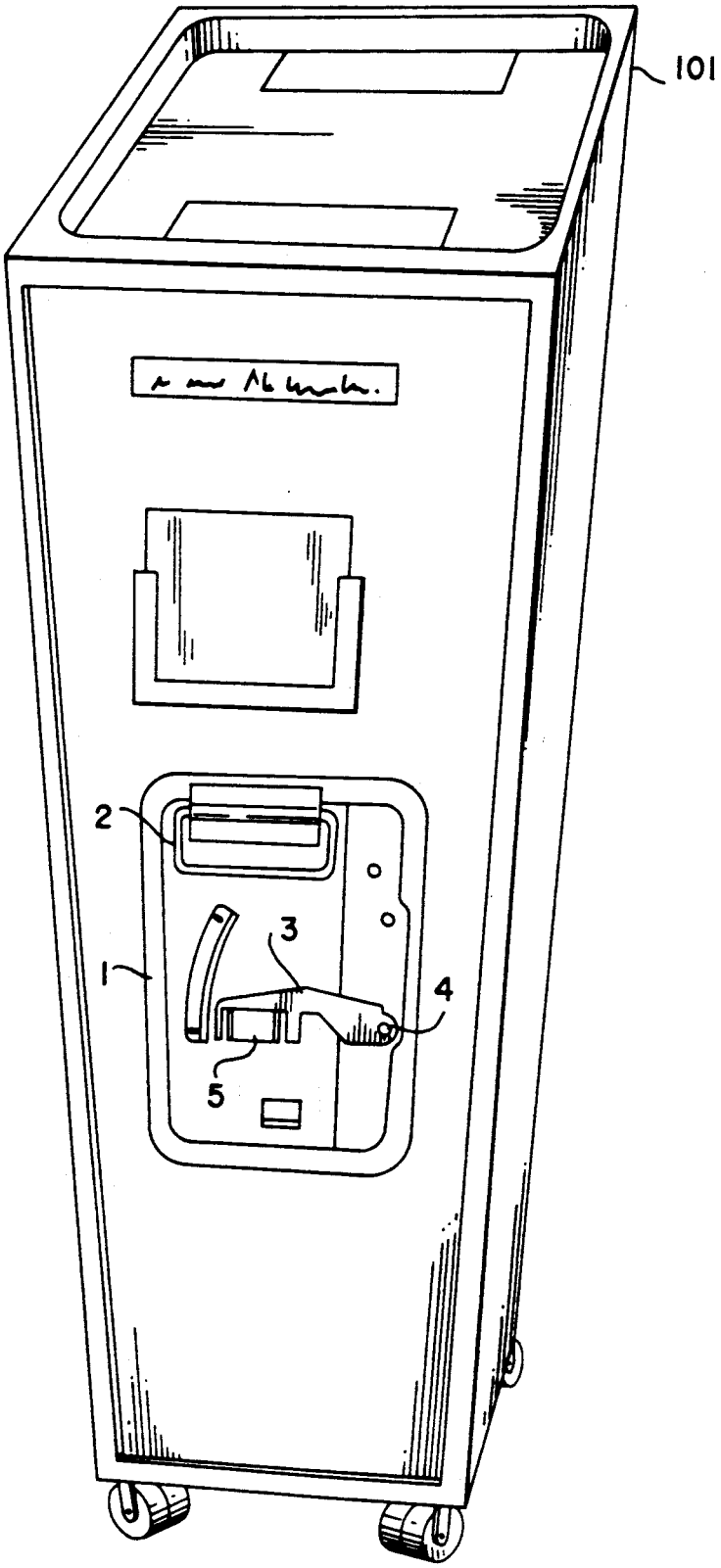
FIG. 9, a perspective view of a trolley containing the drink distributing trolley lock of the present invention.

It can be seen in FIG. 7 that latch 20 escapes from link 6 and, thereafter, the navigating staff may operate handle 3 upwards and open the door. We then have the position illustrated in FIG. 8 in which, because of the rising movement of handle 3, link 6, which has effected a pivoting movement corresponding to the re-entry of sliding bolt 7 and opening of the lock, is positioned against the rounded portion 25 of latch 20.

Thus, latch 20 is locked in the low position against link 6, which prevents the latch from returning upwards despite the fact that spring 23 is tensioned. Lever 8 can then not come back to its first position in which the colored disc 12 would re-appear in the display aperture 13.

When the navigating staff has finished distribution, they close the door by lowering handle 3 which engages the sliding bolt 7 in the keeper. Under the action of spring 23, the latch 20, freed from link 6, rises to the automatic locked position of link 6 (FIG. 6). But lever 8 remains in the position shown in FIG. 6 in which the colored disc is not visible. That means that from the first unlocking effected by the navigating staff, the indication of the complete provisioned state can no longer be displayed by the colored disc 12. If the navigating staff, or the staff of another aircraft wishes to open the door again, they must use the key again for operating the latch. But in any case, because of the single direction of action of its key, it is not possible to replace lever 8 in the original position illustrated in FIG. 5, only the staff of the preparation center could do so with their key having a dual direction of rotation.

I claim:

1. An improved lockable lock for a drink distributing trolley in an aircraft including a control handle (3) operating a sliding bolt (7) by means of a crank link (6), wherein the improvement comprises:

a supplementary latch (20) for locking said sliding bolt (7);

an operating lever (8) operatively connected to said supplementary latch (20) to provide slidable movement of said latch (20) to limit excursion of said bolt (7);

a first key (27*a*) for operating said lever (8) in either a first direction of rotation or a second direction of rotation, said first direction of rotation corresponding to a provision locking state of said trolley; and a second key (27*b*) for operating said lever (8) in only said second direction of rotation, wherein a part of a pivoting shaft situated in the outside of a door (1) has passing therethrough a transverse pin (26) allowing rotation of said pivoting shaft (9) by means of said first key (27*a*) or said second key (27*b*).

2. An improved lockable lock for a drink distributing trolley in an aircraft including a control handle (3) operating a sliding bolt (7) by means of a crank link (6), wherein the improvement comprises:

a supplementary latch (20) for locking said sliding bolt (7);

an operating lever (8) operatively connected to said supplementary latch (20) to provide slidable movement of said latch (20) to limit excursion of said bolt (7);

a first key (27*a*) for operating said lever (8) in either a first direction of rotation or a second direction of rotation, said first direction of rotation corresponding to a provision locking state of said trolley; and a second key (27*b*) for operating said lever (8) in only said second direction of rotation wherein said operating lever (8) is in the form of a right-angled bracket having a first leg (11) and a second leg (14), said first leg (11) having at its end a colored disc (12) on its face oriented towards a door (1), which may appear through a display aperture (13) provided in the door (1) above a shaft (9), wherein said second leg (14) of the operating lever (8) has at its end a profiled opening (15) through which passes a small shaft (18) which is movable in said opening (15).

3. A lockable lock according to claim 2, wherein said latch (20) extends vertically along a rear face of the door (1), between the operating lever (8) with which it cooperates via the shaft (18) passing through an aperture (19) of said latch, and the link (6) controlling the sliding bolt (7).

4. An improved lockable lock for a drink distributing trolley in an aircraft including a control handle (3) operating a sliding bolt (7) by means of a crank link (6), wherein the improvement comprises:

a supplementary latch (20) for locking said sliding bolt (7);

an operating lever (8) operatively connected to said supplementary latch (20) to provide slidable movement of said latch (20) to limit excursion of said bolt (7);

a first key (27*a*) for operating said lever (8) in either a first direction of rotation or a second direction of rotation, said first direction of rotation corresponding to a provision locking state of said trolley; and a second key (27*b*) for operating said lever (8) in only said second direction of rotation, wherein a lower part of the latch (20) is in the form of an L whose flat end (24) as well as an adjacent rounded portion (25) are intended to be applied against a lower part of the crank link (6) of the sliding bolt (7).

5. An improved lockable lock for a drink distributing trolley in an aircraft including a control handle (3) operating a sliding bolt (7) by means of a crank link (6), wherein the improvement comprises:

a supplementary latch (20) for locking said sliding bolt (7);

an operating lever (8) operatively connected to said supplementary latch (20) to provide slidable movement of said latch (20) to limit excursion of said bolt (7);

a first key (27*a*) for operating said lever (8) in either a first direction of rotation or a second direction of rotation, said first direction of rotation corresponding to a provision locking state of said trolley; and a second key (27*b*) for operating said lever (8) in only said second direction of rotation, wherein a barrel (28) of said first key (27*a*) ends in a double diametrical notch (29) able to be engaged on a pin (26), on each side of a shaft (9).

6. An improved lockable lock for a drink distributing trolley in an aircraft including a control handle (3) operating a sliding bolt (7) by means of a crank link (6), wherein the improvement comprises:

a supplementary latch (20) for locking said sliding bolt (7);

an operating lever (8) operatively connected to said supplementary latch (20) to provide slidable movement of said latch (20) to limit excursion of said bolt (7);

a first key (27*a*) for operating said lever (8) in either a first direction of rotation or a second direction of rotation, said first direction of rotation corresponding to a provision locking state of said trolley; and a second key (27*b*) for operating said lever (8) in only said second direction of rotation, wherein a barrel of said second key (27*b*) ends in notches (30) bordered on one side by inclined surfaces (31) and on the other side by straight portions (32) parallel to the longitudinal axis of the key which act in one of said directions on a pin (26).

* * * * *